United States Patent [19]

Case et al.

[11] 4,170,478

[45] Oct. 9, 1979

[54] PHOTOGRAPHIC COLOR DEVELOPER COMPOSITIONS

[75] Inventors: Nelson S. Case; Danny L. Wyatt, both of Rochester, N.Y.

[73] Assignee: Eastman Kodak Company, Rochester, N.Y.

[21] Appl. No.: 884,086

[22] Filed: Mar. 6, 1978

Related U.S. Application Data

[63] Continuation-in-part of Ser. No. 804,045, Jun. 6, 1977, abandoned.

[51] Int. Cl.[2] ..... G03C 5/30

[52] U.S. Cl. ..... 96/66.4; 96/66.5; 96/22; 96/56

[58] Field of Search ..... 96/66.4, 66.5, 22, 56

[56] References Cited

U.S. PATENT DOCUMENTS

| | | | |
|---|---|---|---|
| 1,925,557 | 9/1933 | Dundon | 96/66.4 |
| 2,113,312 | 4/1938 | Vittum | 96/66.4 |
| 2,156,626 | 5/1939 | Ham | 96/66.4 |
| 2,255,731 | 9/1941 | Ham et al. | 96/66.4 |
| 2,306,923 | 12/1942 | Wood | 96/66.5 |
| 2,311,428 | 2/1943 | Wood | 96/66 R |
| 2,371,740 | 3/1945 | Dearing | 96/66.4 |
| 2,840,471 | 6/1958 | Berry | 96/66.4 |
| 3,141,771 | 7/1964 | Bard | 96/66.4 |
| 3,489,566 | 1/1970 | Anselm | 96/22 |
| 3,520,690 | 7/1970 | Nagae | 96/22 |
| 3,619,185 | 11/1971 | Kasman | 96/66.4 |
| 3,823,017 | 7/1974 | Hodes | 96/66.4 |
| 3,832,174 | 8/1974 | Bello | 96/22 |
| 4,066,461 | 1/1978 | Shimamura | 96/66.4 |
| 4,075,014 | 2/1978 | Gerhardt | 96/60 BF |

*Primary Examiner*—Mary F. Kelley
*Attorney, Agent, or Firm*—A. P. Lorenzo

[57] ABSTRACT

An hydroxylamine and a member selected from the group consisting of alkanolamines which are free of carboxyl substitution, aliphatic monoamino monocarboxylic acids of up to three carbon atoms, and aminobenzoic acids, are employed in combination in a photographic color developing composition comprising a primary aromatic amino color developing agent for the purpose of retarding aerial oxidation of the developing agent. This combination can be used to replace all or part of the sulfite that is commonly employed in color developers, to thereby avoid or reduce the disadvantages resulting from the fact that sulfite competes with couplers for oxidized developing agent.

39 Claims, No Drawings

PHOTOGRAPHIC COLOR DEVELOPER COMPOSITIONS

This application is a continuation-in-part of application Ser. No. 804,045, "Photographic Color Developer Compositions", N. S. Case and D. L. Wyatt, filed June 6, 1977 and now abandoned.

This invention relates in general to color photography and in particular to new and improved color developing compositions and processes for forming photographic color images. More specifically, this invention relates to color development with a color developing composition containing a primary aromatic amino color developing agent in combination with certain amine compounds which function to retard aerial oxidation of the developing agent.

The formation of color photographic images by the image-wise coupling of oxidized primary aromatic amino developing agents with color forming or coupling compounds to form indoaniline, indophenol, and azomethine dyes is well known. In these processes, the subtractive process of color formation is ordinarily used and the image dyes customarily formed are cyan, magenta, and yellow, the colors that are complementary to the primary colors, red, green, and blue, respectively. Usually, phenol or naphthol couplers are used to form the cyan dye image; pyrazolone or cyanoacetyl derivative couplers are used to form the magenta dye image; and acylacetamide couplers are used to form the yellow dye image.

In these color photographic systems, the color-forming coupler may be either in the developer solution or incorporated in the light-sensitive photographic emulsion layer so that, during development, it is available in the emulsion layer to react with the color developing agent that is oxidized by silver image development. Diffusible couplers are used in color developer solutions. Nondiffusing couplers are incorporated in photographic emulsion layers. When the dye image formed is to be used in situ, couplers are selected which form nondiffusing dyes. For image transfer color processes, couplers are used which will produce diffusible dyes capable of being mordanted or fixed in the receiving sheet.

It is common practice in the photographic art to include a sulfite in color developer compositions containing primary aromatic amino color developing agents. Typically, the sulfite utilized is in the form of an alkali metal sulfite or bisulfite. It is employed for the purpose of retarding aerial oxidation of the primary aromatic amino color developing agent and is generally quite effective for this purpose. However, the amount of sulfite which can be tolerated in the developer solution is limited by the fact that sulfite competes with couplers for oxidized developing agent and thereby adversely affects dye formation. Typically, yellow-dye-forming couplers react with oxidized developing agent more slowly than cyan-dye-forming couplers or magenta-dye-forming couplers so that the competition between coupler and sulfite has the greatest adverse effect on the formation of the yellow dye image.

Current trends in photographic processing favor lower replenishment rates in color processes and these have presented problems associated with lower turnover rates and higher concentrations of replenisher ingredients. Lower turnover rates result in longer residence time for solutions in the processor. This produces greater aerial oxidation of the developing agent. This tendency can be counteracted by increasing the concentration of sulfite in the developer solution but, in turn, this results in adverse effects on the dye images, especially a lowering of yellow shoulder and yellow D-max, because of the fact that sulfite competes with couplers for oxidized developing agent. Thus, if the amount of sulfite is kept low enough that the decrease in yellow dye density is slight then the developing solution will not have adequate protection against aerial oxidation while if the amount of sulfite is increased to provide adequate protection against aerial oxidation then the adverse effects on dye density will be severe and may reach unacceptable levels.

It has now been discovered that photographic color developer compositions containing a primary aromatic amino color developing agent can be protected against aerial oxidation by the use of a combination of (1) an hydroxylamine and (2) a member selected from the group consisting of alkanolamines which are free of carboxyl substitution, aliphatic monoamino monocarboxylic acids of up to three carbon atoms, and aminobenzoic acids, and that such combination will provide effective protection without adversely affecting the density of the dye images. By use of the aforesaid combination, it is possible to greatly reduce or completely eliminate sulfite to thereby reduce or avoid the deleterious effects of sulfite on the dye images.

Alkanolamines have been used in color developer solutions heretofore. For example, they have been used in color developer solutions as loading agents as described in British Pat. No. 454,622; they have been used in color developer solutions in order to provide improved color saturation as described in British Pat. No. 520,528; they have been used in color developer solutions as development accelerators as described in U.S. Pat. No. 2,371,740 and in British Pat. No. 931,018; and they have been used in color developer solutions as anti-oxidants as described in U.S. Pat. No. 3,823,017. Hydroxylamines have also been used heretofore in color developer solutions. For example, U.S. Pat. Nos. 3,141,771 and 3,489,566 describe the use of hydroxylamines in color developer solutions for the purpose of facilitating the use of balancing developing agents, U.S. Pat. No. 3,746,544 describes the use of hydroxylamines in color developer solutions as anti-oxidants and British Pat. No. 1,420,656 describes the use of hydroxylamine and substituted hydroxylamines in color developer solutions as anti-oxidants. However, color developer solutions which contain both an hydroxylamine and a member selected from the group consisting of alkanolamines which are free of carboxyl substitution, aliphatic monoamino monocarboxylic acids of up to three carbon atoms, and aminobenzoic acids, are novel and provide important unexpected results in color processing.

Sulfite has long been considered by those skilled in the art of photographic processing to be an essential component of color developer compositions and it was unexpected and surprising to find that it could be omitted. The combination of an hydroxylamine and a member selected from the group consisting of alkanolamines which are free of carboxyl substitution, aliphatic monoamino monocarboxylic acids of up to three carbon atoms, and aminobenzoic acids, can, of course, also be incorporated in color developer compositions which do contain sulfite to obtain the advantage of increased protection against aerial oxidation and consequent prolonged life but without the benefit of eliminating the adverse effects of sulfite on dye image densities. Use of the combination of an hydroxylamine and a member selected from the group consisting of alkanolamines which are free of carboxyl substitution, aliphatic monoamino monocarboxylic acids of up to three carbon atoms, and aminobenzoic acids, has other important advantageous benefits, whether or not sulfite is omitted. For example, it reduces tar formation and retards stain growth. Moreover, alkanolamines act as a solubilizing agent for the developing agent, act as a solubilizing agent for benzyl alcohol in those instances in which benzyl alcohol is included in the developing solution, and provide a supplemental source of alkalinity. For these reasons, the preferred anti-oxidant system for use in the present invention is composed of an hydroxylamine and an alkanolamine.

The combination of an hydroxylamine and a member selected from the group consisting of alkanolamines which are free of carboxyl substitution, aliphatic monoamino monocarboxylic acids of up to three carbon atoms, and aminobenzoic acids, can be advantageously utilized in working developer solutions, in replenisher solutions, and in developer concentrates utilized to facilitate packaging of color developer compositions in kit form.

As used herein, the term "an hydroxylamine" refers to an amine in which the nitrogen atom is directly attached to an hydroxyl radical, i.e., the amine comprises an hydroxy amino group of the formula >N—OH, and the term "an alkanolamine" refers to an amine in which the nitrogen atom is directly attached to an hydroxyalkyl radical, i.e., the amine comprises an >N—X—OH group wherein X is alkylene.

The radicals attached to the free bonds in the aforesaid >N—OH and >N—X—OH groups can be hydrogen atoms or organic radicals, e.g., unsubstituted hydrocarbon radicals or substituted hydrocarbon radicals. They are preferably hydrogen atoms or hydrocarbyl radicals of 1 to 12 carbon atoms, for example, alkyl, aryl, alkaryl, or aralkyl radicals. Particularly useful alkanolamines are alkanolamines which are secondary monoamines, tertiary monoamines, secondary diamines, or tertiary diamines.

The primary aromatic amino color developing agents that are utilized in the compositions and methods of this invention are well known and widely used in a variety of color photographic processes. They include aminophenols and p-phenylenediamines. They are usually used in the salt form, such as the hydrochloride or sulfate, as the salt form is more stable than the free amine, and are generally employed in concentrations of from about 0.1 to about 20 grams per liter of developing solution and more preferably from about 0.5 to about 10 grams per liter of developing solution.

Examples of aminophenol developing agents include o-aminophenol, p-aminophenol, 5-amino-2-hydroxytoluene, 2-amino-3-hydroxy-toluene, 2-hydroxy-3-amino-1,4-dimethyl-benzene, and the like.

Particularly useful primary aromatic amino color developing agents are the p-phenylenediamines and especially the N,N-dialkyl-p-phenylenediamines in which the alkyl groups or the aromatic nucleus can be substituted or unsubstituted. Examples of useful p-phenylenediamine color developing agents include N,N-diethyl-p-phenylenediamine monohydrochloride, 2-amino-5-diethylaminotoluene monohydrochloride, 4-amino-N-ethyl-N-[β-methanesulfonamidoethyl]-m-toluidine sesquisulfate monohydrate, 4-amino-3-methyl-N-ethyl-N-[β-hydroxyethyl]-aniline sulfate, 4-amino-3-(β-methyl-sulfonamidoethyl)-N,N-diethylaniline hydrochloride, 4-amino-N,N-diethyl-3-(N'-methyl-β-methylsulfonamido)-aniline hydrochloride and similar color developing agents disclosed in U.S. Pat. Nos. 2,552,241 and 2,566,271. An especially preferred class of p-phenylenediamine developing agents are those containing at least one alkylsulfonamidoalkyl substituent attached to the aromatic nucleus or to an amino nitrogen. Other especially preferred classes of p-phenylenediamines are the 3-alkyl-N-alkyl-N-alkoxyalkyl-p-phenylenediamines and the 3-alkoxy-N-alkyl-N-alkoxy-alkyl-p-phenylenediamines. These developing agents are described in U.S. Pat. Nos. 3,656,950 and 3,658,525 and can be represented by the formula:

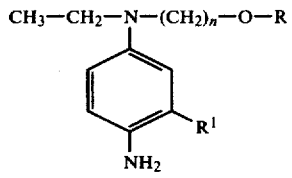

wherein n is an integer having a value of from 2 to 4, L R is an alkyl group of from 1 to 4 carbon atoms, and $R^1$ is an alkyl group of from 1 to 4 carbon atoms or an alkoxy group of from 1 to 4 carbon atoms. Illustrative examples of these developing agents include the following compounds:

N-ethyl-N-methoxyethyl-3-methyl-p-phenylenediamine
N-ethyl-N-methoxybutyl-3-methyl-p-phenylenediamine
N-ethyl-N-ethoxyethyl-3-methyl-p-phenylenediamine
N-ethyl-N-methoxyethyl-3-n-propyl-p-phenylenediamine
N-ethyl-N-methoxyethyl-3-methoxy-p-phenylenediamine
N-ethyl-N-butoxyethyl-3-methyl-p-phenylenediamine
and the like.

Optional ingredients which can be included in the color developing compositions of this invention include alkalies to control pH, thiocyanates, bromides, iodides, benzyl alcohol, thickening agents, solubilizing agents, sequestering agents, brightening agents, and so forth. The pH of the developing solution is ordinarily above 7 and most typically about 10 to about 13.

Hydroxylamine can be utilized in the color developer solutions of this invention in the form of the free amine but is more typically employed in the form of a water-soluble acid salt. Typical examples of such salts are sulfates, oxalates, chlorides, phosphates, carbonates, acetates, and the like. The hydroxylamine can be substituted or unsubstituted, for example, the nitrogen atom of the hydroxylamine can be substituted with alkyl radicals. Preferred hydroxylamines are those of the formula;

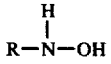

wherein R is a hydrogen atom or an alkyl group of 1 to 3 carbon atoms, and water-soluble acid salts thereof.

Alkanolamines which are preferred for use in the color developer compositions of this invention are compounds of the formula:

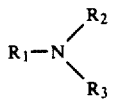

wherein $R_1$ is an hydroxyalkyl group of 2 to 6 carbon atoms and each of $R_2$ and $R_3$ is a hydrogen atom, an alkyl group of 1 to 6 carbon atoms, an hydroxyalkyl group of 2 to 6 carbon atoms, a benzyl radical, or a

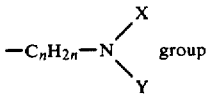

wherein n is an integer of from 1 to 6 and each of X and Y is a hydrogen atom, an alkyl group of 1 to 6 carbon atoms or an hydroxylalkyl group of 2 to 6 carbon atoms. Alkanolamines which are especially preferred are compounds of the formula:

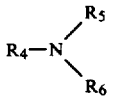

wherein $R_4$ is an hydroxyalkyl group of 2 to 4 carbon atoms and each of $R_5$ and $R_6$ is an alkyl group of 1 to 4 carbon atoms or an hydroxyalkyl group of 2 to 4 carbon atoms. Typical examples of alkanolamines which can be used in the color developer compositions of this invention include:

ethanolamine
diethanolamine
triethanolamine
di-isopropanolamine
2-methylaminoethanol
2-ethylaminoethanol
2-dimethylaminoethanol
2-diethylaminoethanol
1-diethylamino-2-propanol
3-diethylamino-1-propanol
3-dimethylamino-1-propanol
isopropylaminoethanol
3-amino-1-propanol
2-amino-2-methyl-1,3-propanediol
ethylenediamine tetraisopropanol
benzyldiethanolamine
2-amino-2-(hydroxymethyl)-1,3-propanediol and the like.

As indicated hereinabove, in place of the alkanolamine there can be used in the anti-oxidant system of this invention an aliphatic monoamino monocarboxylic acid of up to 3 carbon atoms, such as for example, glycine, L-alanine, β-alanine, L-(−)-serine or dL-serine. Also, in place of the alkanolamine there can be used an aminobenzoic acid such as, for example, ortho-aminobenzoic acid or para-aminobenzoic acid.

In accordance with this invention an hydroxylamine is preferably included in the color developer composition in an amount of from about 1 to about 8 moles per mole of primary aromatic amino color developing agent, more preferably in an amount of from about 2 to about 7 moles per mole, and most preferably in an amount of from about 3 to about 5 moles per mole. The member selected from the group consisting of alkanolamines which are free of carboxyl substitution, aliphatic monoamino monocarboxylic acids of up to 3 carbon atoms, and aminobenzoic acids, is preferably included in an amount of from about 4 to about 30 moles per mole of primary aromatic amino color developing agent, more preferably in an amount of from about 5 to about 20 moles per mole, and most preferably in an amount of from about 6 to about 12 moles per mole. Advantageously, the color developer composition is free of sulfite or contains only a low concentration of sulfite, i.e., an amount of sulfite not exceeding 0.2 moles per mole of primary aromatic amino color developing agent. However, the invention broadly encompasses the use of an hydroxylamine and a member selected from the group consisting of alkanolamines which are free of carboxyl substitution, aliphatic monoamino monocarboxylic acids of up to 3 carbon atoms, and aminobenzoic acids, in any amount that is sufficient to retard aerial oxidation of the developing agent and includes developer compositions which include sulfite in any amount as well as those which are free of sulfite.

Development of photographic elements in the color developer compositions described herein can be advantageously employed in the processing of photographic elements designed for reversal color processing or in the processing of negative color elements or color print materials. The novel combination of anti-oxidants described herein can be employed with photographic elements which are processed in color developers containing couplers or with photographic elements which contain the coupler in the silver halide emulsion layers or in layers contiguous thereto. The photosensitive layers present in the photographic elements processed according to the method of this invention can contain any of the conventional silver halides as the photosensitive material, for example, silver chloride, silver bromide, silver bromoiodide, silver chlorobromide, silver chloroiodide, silver chlorobromoiodide, and mixtures thereof. These layers can contain conventional addenda and be coated on any of the photographic supports, such as, for example, cellulose nitrate film, cellulose acetate film, polyvinyl acetal film, polycarbonate film, polystyrene film, polyethylene terephthalate film, paper, polymer-coated paper, and the like.

Use of a combination of an hydroxylamine and an alkanolamine as a preservative for color developers is especially advantageous with developer compositions which contain benzyl alcohol. In such compositions, the benzyl alcohol is usually present in an amount of from about 10 to about 20 grams per liter of working developer solution and preferably in an amount of from about 10 to about 15 grams per liter. Typically, such compositions contain a glycol, such as ethylene glycol, as a solubilizer for the benzyl alcohol but it will ordinarily be possible to eliminate the use of a glycol for this purpose in the color developer compositions of this invention which contain an alkanolamine in view of the excellent solubilizing characteristics of the alkanolamine.

The invention is further illustrated by the following examples of its practice.

EXAMPLE 1

Anti-oxidants as described in Table I below were incorporated in a photographic color developer solution in which the primary aromatic amino color developing agent was 4-amino-N-ethyl-N-(β-methanesulfonamidoethyl)-m-toluidine sesquisulfate monohydrate.

The color developer solutions also contained benzyl alcohol, potassium carbonate, potassium bromide, potassium chloride, potassium hydroxide, sequestering agents and stain reducing agents. The color developer solutions were stored at room temperature in glass beakers covered with watchglass covers to minimize evaporation and keep out dirt and, at weekly intervals, a photographic color print paper comprising a polyethylene-coated paper base bearing in order a blue-light-sensitive gelatin silver halide emulsion layer containing a yellow-dye-forming coupler, a green-light-sensitive gelatin silver halide emulsion layer containing a magenta-dye-forming coupler and a red-light-sensitive gelatin silver halide emulsion layer containing a cyan-dye-forming coupler, was exposed, developed in the aforesaid color developing solutions, bleach-fixed, washed, and tested to determine the maximum density of the yellow dye image. In Table I, the symbols TEA, HAS and $SO_3^{32}$ refer, respectively, to triethanolamine, hydroxylamine sulfate, and the sulfite ion (which was incorporated in the developer solution as potassium sulfite). The symbol M identifies a molar concentration. Values reported in the table are in each instance the yellow D-max after the specified number of weeks of storage.

Consideration of the data reported in Table I indicates that Developer No. 4, which contained both TEA and HAS, and Developer No. 8 which contained TEA, HAS and $SO_3^{=}$, retained their ability to function as color developing compositions far longer than did any of the other developers tested. To be commercially useful, it would typically be necessary for the developer solution to be capable of producing a yellow D-max of at least 2.0 so that, under the test conditions utilized, Developer No. 4 has a useful life of about 13 weeks and Developer No. 8 has a useful life of about 16 weeks whereas Developer No. 1 has a useful life of only about 2 weeks.

EXAMPLE 2

Anti-oxidants as described in Table II below were incorporated in the photographic color developer solution described in Example 1 and the photographic color print paper was exposed, processed and tested in the same manner described in Example 1 to determine yellow D-max. In Table II the symbol DEA refers to diethanolamine. Values reported in the table are the average of the values obtained for the two weekly intervals indicated.

Table I

| Developer | 1 | 2 | 3 | 4 | 5 | 6 | 7 | 8 |
|---|---|---|---|---|---|---|---|---|
| Level of TEA | 0 | .1M | 0 | .1M | 0 | .1M | 0 | .1M |
| Level of HAS | 0 | 0 | .06M | .06M | 0 | 0 | .06M | .06M |
| Level of $SO_3^{=}$ | 0 | 0 | 0 | 0 | .02M | .02M | .02M | .02M |
| Weeks | | | | | | | | |
| 0 | 2.25 | 2.24 | 2.26 | 2.31 | 2.14 | 2.12 | 2.15 | 2.07 |
| 1 | 2.27 | 2.24 | 2.28 | 2.28 | 2.2 | 2.09 | 2.21 | 2.11 |
| 2 | 2.14 | 2.24 | 2.28 | 2.24 | 2.08 | 2.09 | 2.28 | 2.26 |
| 3 | 1.65 | 1.95 | 2.29 | 2.33 | 1.53 | 1.51 | 2.27 | 2.18 |
| 4 | 1.05 | 1.62 | 1.90 | 2.34 | 1.22 | 1.17 | 2.28 | 2.20 |
| 5 | 0.57 | 1.02 | 1.33 | 2.32 | 0.59 | 0.35 | 2.26 | 2.28 |
| 6 | 0.27 | 0.71 | 0.79 | 2.29 | 0.31 | 0 | 2.27 | 2.27 |
| 7 | 0 | 0.39 | 0.50 | 2.27 | 0 | | 2.30 | 2.24 |
| 8 | | 0.18 | 0.20 | 2.26 | | | 2.27 | 2.22 |
| 9 | | 0 | 0.06 | 2.26 | | | 2.23 | 2.25 |
| 10 | | | 0 | 2.29 | | | 2.13 | 2.30 |
| 11 | | | | 2.17 | | | 2.00 | 1.97 |
| 12 | | | | 2.16 | | | 1.40 | 1.97 |
| 13 | | | | 2.08 | | | 1.36 | 2.21 |
| 14 | | | | 1.90 | | | 0.75 | 2.19 |
| 15 | | | | 1.69 | | | 0.66 | 2.25 |
| 16 | | | | 1.35 | | | 0.22 | 2.04 |
| 17 | | | | 0.92 | | | 0 | |
| | | | | | | | 1.98 | |
| 18 | | | | 0.79 | | | | 1.57 |
| 19 | | | | 0.53 | | | | 1.24 |
| 20 | | | | 0.29 | | | | 1.07 |
| 21 | | | | 0.14 | | | | 1.07 |
| 22 | | | | 0 | | | | 0.71 |
| 23 | | | | | | | | 0.39 |
| 24 | | | | | | | | 0 |

Table II

| Developer | 9 | 10 | 11 | 12 | 13 | 14 | 15 | 16 |
|---|---|---|---|---|---|---|---|---|
| Level of HAS | .06M | .06M | .06M | .06M | .06M | .06M | .06M | .06M |
| Level of DEA | 0 | .16M | 0 | .16M | 0 | .16M | 0 | .16M |
| Level of TEA | 0 | 0 | .1M | .1M | 0 | 0 | .1M | .1M |
| Level of $SO_3^{=}$ | 0 | 0 | 0 | 0 | .02M | .02M | .02M | .02M |
| WEEKS | | | | | | | | |
| 0–1 | 2.25 | 2.28 | 2.24 | 2.30 | 2.12 | 2.05 | 2.06 | 2.00 |
| 2–3 | 2.24 | 2.19 | 2.22 | 2.18 | 2.21 | 2.24 | 2.18 | 2.21 |
| 4–5 | 1.77 | 2.31 | 2.30 | 2.33 | 2.25 | 2.23 | 2.22 | 2.16 |
| 6–7 | 0.75 | 2.20 | 2.25 | 2.28 | 2.26 | 2.16 | 2.15 | 2.18 |
| 8–9 | 0.18 | 2.10 | 2.22 | 2.28 | 2.19 | 2.16 | 2.16 | 2.22 |
| 10–11 | 0 | 1.90 | 2.12 | 2.18 | 1.80 | 2.12 | 2.07 | 2.08 |
| 12–13 | | 1.81 | 2.05 | 2.11 | 1.38 | 2.03 | 2.12 | 2.11 |
| 14–15 | | 1.62 | 1.83 | 2.02 | 0.73 | 1.93 | 2.16 | 2.13 |
| 16–17 | | 1.49 | 1.20 | 1.92 | 0.14 | 1.84 | 1.90 | 2.03 |

Table II-continued

| Developer | 9 | 10 | 11 | 12 | 13 | 14 | 15 | 16 |
|---|---|---|---|---|---|---|---|---|
| Level of HAS | .06M | .06M | .06M | .06M | .06M | .06M | .06M | .06M |
| Level of DEA | 0 | .16M | 0 | .16M | 0 | .16M | 0 | .16M |
| Level of TEA | 0 | 0 | .1M | .1M | 0 | 0 | .1M | .1M |
| Level of $SO_3^=$ | 0 | 0 | 0 | 0 | .02M | .02M | .02M | .02M |
| 18-19 | | 1.33 | 0.76 | 1.80 | 0 | 1.75 | 1.45 | 1.86 |
| 20-21 | | 1.36 | 0.31 | 1.80 | | 1.83 | 1.10 | 1.67 |
| 22-23 | | 1.16 | 0 45 | 1.59 | | 1.64 | 0.61 | 1.40 |
| 24-25 | | 1.02 | | 1.16 | | 1.35 | 0.05 | 0.95 |
| 26-27 | | 0.89 | | 0.90 | | 1.29 | 0 | 0.72 |
| 28-29 | | 0.84 | | 0.69 | | 1.14 | | 0.52 |
| 30-31 | | 0.72 | | 0.48 | | 0.97 | | 0.29 |
| 32-33 | | 0.58 | | 0.32 | | 0.79 | | 0.12 |

Consideration of the data reported in Table II indicates that the developers within the scope of the invention, namely developers 10, 11, 12, 14, 15 and 16 retained their ability to function as color developing compositions longer than Developer No. 9 which contained only HAS and Developer No. 13 which contained HAS and $SO_3^=$. For example, Developer No. 14 exhibited a useful life of about 13 weeks as compared to only about 3 weeks for Developer No. 9.

EXAMPLE 3

Anti-oxidants as described in Table III below were incorporated in the photographic color developer solution described in Example 1 and the photographic color print paper was exposed, processed and tested in the same manner described in Example 1 to determine yellow D-max. Values reported in the table are the average of the values obtained for the two weekly intervals indicated.

Table III

| Developer | 17 | 18 |
|---|---|---|
| Level of HAS | 0.058M | 0.058M |
| Level of Glycine | 0 | 0.2M |
| WEEKS | | |
| 0-1 | 2.26 | 2.32 |
| 2-3 | 2.25 | 2.26 |
| 4-5 | 1.90 | 2.29 |
| 6-7 | 0.96 | 2.10 |
| 8-9 | 0.28 | 2.02 |
| 10-11 | 0.01 | 1.78 |
| 12-13 | 0 | 1.59 |
| 14-15 | | 1.56 |
| 16-17 | | 1.48 |
| 18-19 | | 1.24 |
| 20-21 | | 1.08 |
| 22-23 | | 1.06 |
| 24-25 | | 0.72 |
| 26-27 | | 0.60 |
| 28-29 | | 0.50 |
| 30-31 | | 0.40 |
| 32-33 | | 0.38 |

Consideration of the data reported in Table III indicates that Developer No. 18 which contains both HAS and glycine and, accordingly, is within the scope of the invention retained its ability to function as a color developing composition far longer than Developer No. 17 which contains only HAS and, accordingly, is outside the scope of the invention. Developer No. 18 exhibited a useful life of about 9 weeks as compared to only about 3 weeks for Developer No. 17.

EXAMPLE 4

Anti-oxidants as described in Table IV below were incorporated in a photographic color developer solution in which the primary aromatic amino color developing agent was 4-amino-N-ethyl-N-(β-methanesulfonamidoethyl)-m-toluidine sesquisulfate monohydrate. The color developer solution also contained benzyl alcohol, hydroxylamine sulfate, potassium carbonate, potassium bromide, potassium chloride, potassium hydroxide, sequestering agents and stain reducing agents. In each instance it contained hydroxylamine sulfate at a molar concentration of 0.029 and an anti-oxidant as specified in Table IV at a molar concentration of 0.0536 but contained no sulfite. For purposes of comparison data were also obtained for control No. 1, which contained hydroxylamine sulfate at a molar concentration of 0.029 and no other anti-oxidant, and for control No. 2, which contained hydroxylamine sulfate at a molar concentration of 0.0826 and no other anti-oxidant. In each instance, the number of weeks for the specified maximum density of the yellow dye image was determined in the same manner as described in Example 1. Control No. 1 was repeated three times, control No. 2 was repeated twice, and the evaluation of triethanolamine was repeated three times. Results for all of these repetitions are reported in Table IV.

Table IV

| | Weeks to Yellow $D_{max}$ of: | | | |
|---|---|---|---|---|
| Anti-Oxidant | 2.0 | 1.6 | 0.8 | 0 |
| Control No. 1 | 3.03 | 3.82 | 5.85 | 8.87 |
| | 3.97 | 4.43 | 6.01 | 7.99 |
| | 4.50 | 5.39 | 7.34 | 9.66 |
| Control No. 2 | 4.57 | 5.26 | 7.90 | 10.21 |
| | 4.82 | 5.63 | 7.54 | 10.00 |
| Glycine | 5.31 | 7.69 | 12.01 | 16.88 |
| L-Alanine | 5.04 | 6.08 | 8.00 | 11.42 |
| β-Alanine | 5.49 | 6.38 | 9.02 | 12.35 |
| L-(−)-Serine | 6.08 | 6.65 | 9.67 | 13.69 |
| dL-Serine | 4.76 | 5.96 | 8.66 | 11.98 |
| ortho-Aminobenzoic acid | 6.40 | 7.32 | 9.33 | 12.47 |
| para-Aminobenzoic acid | 6.16 | 6.84 | 8.75 | 11.22 |
| 2-Dimethylamino-ethanol | 8.58 | 9.58 | 12.04 | 14.57 |
| Triethanolamine | 8.39 | 9.36 | 11.54 | 13.80 |
| | 8.21 | 9.38 | 11.49 | 13.77 |
| | 7.82 | 9.45 | 12.05 | 15.01 |
| Ethylenediamine tetraisopropanol | 7.86 | 9.41 | 12.17 | 14.91 |
| Benzyldiethanolamine | 7.21 | 8.26 | 11.21 | 15.12 |
| 2-Ethylaminoethanol | 6.97 | 7.78 | — | — |
| Isopropylaminoethanol | 5.71 | 7.24 | — | — |
| 2-Amino-2-methyl-1,3-propanediol | 5.95 | 6.42 | 8.23 | 11.12 |
| Diethanolamine | 5.54 | 7.91 | 13.13 | 18.81 |
| 3-Amino-1-propanol | 5.37 | 6.25 | 8.66 | 12.06 |
| Ethanolamine | 5.04 | 5.95 | 8.60 | 11.68 |
| 2-Amino-2-(hydroxy-methyl)-1,3-propanediol | 4.73 | 6.00 | 7.97 | 10.39 |

As indicated by the results reported in Table IV above, use of the combination of an hydroxylamine and a member selected from the group consisting of alkanolamines which are free of carboxyl substitution, aliphatic monoamino monocarboxylic acids of up to 3 carbon atoms and aminobenzoic acids provides substantially improved protection against oxidation as compared to the use of an hydroxylamine alone. Thus, for example, the number of weeks for a yellow $D_{max}$ of 2.0 was 8.58 with an anti-oxidant system composed of hydroxylamine sulfate at a molar concentration of 0.029 and 2-dimethylaminoethanol at a molar concentration of 0.0536, whereas it was only 4.57 weeks in control No. 2 in which the protection against oxidation was provided by hydroxylamine sulfate at a molar concentration of 0.0826. Results which are greatly superior to the control are also shown by the other combinations, such as a value of 6.08 weeks with an anti-oxidant system composed of hydroxylamine sulfate at a molar concentration of 0.029 and L-(−)-serine at a molar concentration of 0.0536 and a value of 6.40 weeks with an anti-oxidant system composed of hydroxylamine sulfate at a molar concentration of 0.029 and ortho-aminobenzoic acid at a molar concentration of 0.0536.

EXAMPLE 5

The effectiveness of triethanolamine as an anti-oxidant is further illustrated by the results reported in Table V below in which triethanolamine has been utilized at two different concentration levels in color developer solutions similar to those described in Example 1 which contained either or both of hydroxylamine sulfate and potassium sulfite. In Table V, the symbols TEA, HAS and $SO_3^=$ refer, respectively, to triethanolamine, hydroxylamine sulfate, and the sulfite ion and the number of weeks for the specified maximum density of the yellow dye image was determined in the same manner as described in Example 1.

Table V

| Molar Concentration of: | | | Weeks to Yellow $D_{max}$ of: | | | |
|---|---|---|---|---|---|---|
| TEA | HAS | $SO_3^=$ | 2.0 | 1.6 | 0.8 | 0 |
| 0 | 0 | 0 | 2.34 | 3.07 | 4.70 | 6.85 |
| .0536 | 0 | 0 | 2.17 | 3.22 | 5.17 | 7.84 |
| .1072 | 0 | 0 | 3.11 | 3.93 | 5.82 | 8.86 |
| 0 | .029 | 0 | 3.97 | 4.43 | 6.01 | 7.99 |
| .0536 | .029 | 0 | 8.21 | 9.38 | 11.49 | 13.77 |
| .1072 | .029 | 0 | 9.21 | 10.04 | 12.20 | 14.63 |
| 0 | .058 | 0 | 4.18 | 4.78 | 6.78 | 9.73 |
| .0536 | .058 | 0 | 12.13 | 12.47 | 14.07 | 16.86 |
| .1072 | .058 | 0 | 12.70 | 13.49 | 15.51 | 18.99 |
| 0 | 0 | .0177 | 2.26 | 2.99 | 4.76 | 6.79 |
| .0536 | 0 | .0177 | 1.65 | 2.70 | 4.42 | 6.00 |
| .1072 | 0 | .0177 | 2.18 | 2.86 | 4.42 | 5.87 |
| 0 | .029 | .0177 | 10.20 | 1.099 | 12.58 | 14.49 |
| .0536 | .029 | .0177 | 10.70 | 12.06 | 4.27 | 17.05 |
| .1072 | .029 | .0177 | 10.74 | 11.57 | 3.61 | 15.94 |
| 0 | .058 | .0177 | 8.60 | 9.36 | 10.96 | 13.60 |
| .0536 | .058 | .0177 | 16.51 | 17.21 | 19.22 | 21.10 |
| .1072 | .058 | 0.177 | 13.50 | 14.47 | 16.67 | 19.03 |
| 0 | 0 | .0354 | 1.39 | 2.30 | 4.06 | 5.88 |
| .0536 | 0 | .0354 | 0.37 | 2.01 | 3.90 | 5.75 |
| .1072 | 0 | .0354 | 1.05 | 1.62 | 3.55 | 5.59 |
| 0 | .029 | .0354 | 10.58 | 12.26 | 14.12 | 15.87 |
| .0536 | .029 | .0354 | 8.38 | 11.41 | 14.92 | 16.89 |
| .1072 | .029 | .0354 | 10.26 | 12.11 | 14.28 | 16.05 |
| 0 | .058 | .0354 | 18.51 | 19.27 | 20.89 | 22.91 |
| .0536 | .058 | .0354 | 19.29 | 20.04 | 21.90 | 23.91 |
| .1072 | .058 | .0354 | 18.15 | 19.19 | 21.12 | 22.97 |

As indicated by the data reported in Table V, combinations of triethanolamine and hydroxylamine sulfate are highly effective in providing protection against oxidation even in color developer compositions in which sulfite is omitted.

The invention has been described in detail with particular reference to preferred embodiments thereof, but it will be understood that variations and modifications can be effected within the spirit and scope of the invention.

What is claimed is:

1. A photographic color developing composition comprising (1) a primary aromatic amino color developing agent, (2) an hydroxylamine and (3) a member selected from the group consisting of (a) alkanolamines which are free of carboxyl substitution, and are represented by the formula

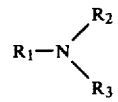

wherein $R_1$ is an hydroxyalkyl group of 2 to 6 carbon atoms and each of $R_2$ and $R_3$ is a hydrogen atom, an alkyl group of 1 to 6 carbon atoms, an hydroxyalkyl group of 2 to 6 carbon atoms, a benzyl radical, or a

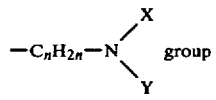

wherein n is an integer of from 1 to 6 and each of X and Y is a hydrogen atom, an alkyl group of 1 to 6 carbon atoms or an hydroxyalkyl group of 2 to 6 carbon atoms, (b) aliphatic monoamino monocarboxylic acids of up to 3 carbon atoms, and (c) aminobenzoic acids; the concentration of (2) and (3) being sufficient to retard aerial oxidation of said primary aromatic amino color developing agent.

2. A photographic color developing composition comprising a primary aromatic amino color developing agent and a concentration sufficient to retard aerial oxidation of said developing agent of a combination of an hydroxylamine with an alkanolamine which is free of carboxyl substitution and is represented by the formula

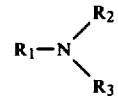

wherein $R_1$ is an hydroxyalkyl group of 2 to 6 carbon atoms and each of $R_2$ and $R_3$ is a hydrogen atom, an alkyl group of 1 to 6 carbon atoms, an hydroxyalkyl group of 2 to 6 carbon atoms, a benzyl radical, or a

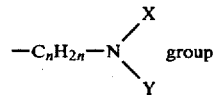

wherein n is an integer of from 1 to 6 and each of X and Y is a hydrogen atom, an alkyl group of 1 to 6 carbon atoms or an hydroxyalkyl group of 2 to 6 carbon atoms.

3. A photographic color developing composition as claimed in claim 2 wherein said alkanolamine is a secondary monoamine, a tertiary monoamine, a secondary diamine or a tertiary diamine.

4. A photographic color developing composition comprising a primary aromatic amino color developing agent and a concentration sufficient to retard aerial oxidation of said developing agent of a combination of an hydroxylamine with an aliphatic monoamino monocarboxylic acid of up to 3 carbon atoms.

5. A photographic color developing composition comprising a primary aromatic amino color developing agent and a concentration sufficient to retard aerial oxidation of said developing agent of a combination of an hydroxylamine with an aminobenzoic acid.

6. A photographic color developing composition comprising (1) a primary aromatic amino color developing agent, (2) an hydroxylamine of the formula

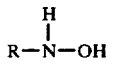

wherein R is a hydrogen atom or an alkyl group of 1 to 3 carbon atoms, or a water-soluble acid salt thereof, and (3) a member selected from the group consisting of (a) alkanolamines which are free of carboxyl substitution and are represented by the formula

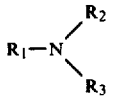

wherein $R_1$ is an hydroxyalkyl group of 2 to 6 carbon atoms and each of $R_2$ and $R_3$ is a hydrogen atom, an alkyl group of 1 to 6 carbon atoms, an hydroxyalkyl group of 2 to 6 carbon atoms, a benzyl radical, or a

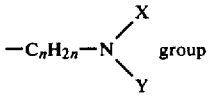

wherein n is an integer of from 1 to 6 and each of X and Y is a hydrogen atom, an alkyl group of 1 to 6 carbon atoms or an hydroxyalkyl group of 2 to 6 carbon atoms, (b) aliphatic monoamino monocarboxylic acids of up to 3 carbon atoms, and (c) aminobenzoic acids; the concentration of (2) and (3) being sufficient to retard aerial oxidation of said primary aromatic amino color developing agent.

7. A photographic color developing composition comprising (1) a primary aromatic amino color developing agent, (2) from about 1 to about 8 moles per mole of said developing agent of an hydroxylamine of the formula

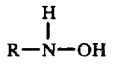

wherein R is a hydrogen atom or an alkyl group of 1 to 3 carbon atoms, or a water-soluble acid salt thereof, and (3) from about 4 to about 30 moles per mole of said developing agent of an alkanolamine which is free of carboxyl substitution and is represented by the formula

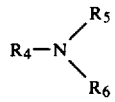

wherein $R_4$ is an hydroxyalkyl group of 2 to 4 carbon atoms and each of $R_5$ and $R_6$ is an alkyl group of 1 to 4 carbon atoms or an hydroxyalkyl group of 2 to 4 carbon atoms.

8. A photographic color developing composition comprising (1) a primary aromatic amino color developing agent, (2) from about 1 to about 8 moles per mole of said developing agent of an hydroxylamine of the formula

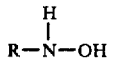

wherein R is a hydrogen atom or an alkyl group of 1 to 3 carbon atoms, or a water-soluble acid salt thereof, (3) from about 4 to about 30 moles per mole of said developing agent of a member selected from the group consisting of (a) alkanolamines which are free of carboxyl substitution and are represented by the formula

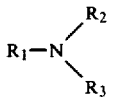

wherein $R_1$ is an hydroxyalkyl group of 2 to 6 carbon atoms and each of $R_2$ and $R_3$ is a hydrogen atom, an alkyl group of 1 to 6 carbon atoms, an hydroxyalkyl group of 2 to 6 carbon atoms, a benzyl radical, or a

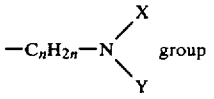

wherein n is an integer of from 1 to 6 and each of X and Y is a hydrogen atom, an alkyl group of 1 to 6 carbon atoms, or an hydroxyalkyl group of 2 to 6 carbon atoms, (b) aliphatic monoamino monocarboxylic acids of up to 3 carbon atoms, and (c) aminobenzoic acids, and (4) from zero to 0.2 moles of sulfite per mole of said developing agent.

9. A photographic color developing composition as claimed in claim 1 wherein said developing agent is a p-phenylenediamine.

10. A photographic color developing composition as claimed in claim 1 wherein said developing agent is an aminophenol.

11. A photographic color developing composition as claimed in claim 1 wherein said developing agent is 4-amino-N-ethyl-N-(β-methanesulfonamidoethyl)-m-toluidine sesquisulfate monohydrate.

12. A photographic color developing composition as claimed in claim 1 wherein said composition additionally contains benzyl alcohol.

13. A photographic color developing composition as claimed in claim 1 which is free of sulfite ions.

14. A photographic color developing composition as claimed in claim 1 wherein (2) is hydroxylamine sulfate and (3) is triethanolamine.

15. A photographic color developing composition as claimed in claim 1 wherein (2) is hydroxylamine sulfate and (3) is diethanolamine.

16. A photographic color developing composition as claimed in claim 1 wherein (2) is hydroxylamine sulfate and (3) is glycine.

17. A photographic color developing composition as claimed in claim 1 wherein (2) is hydroxylamine sulfate and (3) is 2-dimethylaminoethanol.

18. A photographic color developing composition as claimed in claim 1 wherein (2) is hydroxylamine sulfate and (3) is ortho-aminobenzoic acid.

19. A photographic color developing composition containing 4-amino-N-ethyl-N-(β-methanesulfonamidoethyl)-m-toluidine sesquisulfate monohydrate, benzyl alcohol, hydroxylamine sulfate and triethanolamine; said composition being free of sulfite ions and containing a sufficient concentration of said hydroxylamine sulfate and said triethanolamine to retard aerial oxidation of said 4-amino-N-ethyl-N-(β-methanesulfonamidoethyl)-m-toluidine sesquisulfate monohydrate.

20. A method of retarding aerial oxidation of a primary aromatic amino color developing agent in a photographic color developing solution so as to increase the useful life of said solution, which method comprises incorporating in said solution a combination of an hydroxylamine with a member selected from the group consisting of (a) alkanolamines which are free of carboxyl substitution, and are represented by the formula

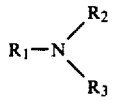

wherein $R_1$ is an hydroxyalkyl group of 2 to 6 carbon atoms and each of $R_2$ and $R_3$ is a hydrogen atom, an alkyl group of 1 to 6 carbon atoms, an hydroxyalkyl group of 2 to 6 carbon atoms, a benzyl radical, or a

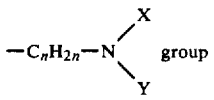

wherein n is an integer of from 1 to 6 and each of X and Y is a hydrogen atom, an alkyl group of 1 to 6 carbon atoms, or an hydroxyalkyl group of 2 to 6 carbon atoms, (b) aliphatic monoamino monocarboxylic acids of up to 3 carbon atoms, and (c) aminobenzoic acids, the concentration of said combination being sufficient to retard aerial oxidation of said developing agent.

21. A method as claimed in claim 20 wherein said hydroxylamine is a compound of the formula

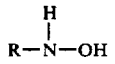

wherein R is a hydrogen atom or an alkyl group of 1 to 3 carbon atoms, or a water-soluble acid salt thereof.

22. A method as claimed in claim 20 wherein said alkanolamine has the formula:

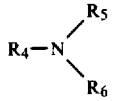

wherein $R_4$ is an hydroxyalkyl group of 2 to 4 carbon atoms and each of $R_5$ and $R_6$ is an alkyl group of 1 to 4 carbon atoms or an hydroxyalkyl group of 2 to 4 carbon atoms.

23. A method as claimed in claim 20 wherein said hydroxylamine is hydroxylamine sulfate.

24. A method as claimed in claim 20 wherein said alkanolamine is triethanolamine.

25. A method as claimed in claim 20 wherein said alkanolamine is diethanolamine.

26. A method as claimed in claim 20 wherein said alkanolamine is 2-dimethylaminoethanol.

27. A method as claimed in claim 20 wherein said aliphatic monoamino monocarboxylic acid is glycine.

28. A method as claimed in claim 20 wherein said aminobenzoic acid is ortho-aminobenzoic acid.

29. A method as claimed in claim 20 wherein said developing agent is 4-amino-N-ethyl-N-(β-methane-sulfonamidoethyl)-m-toluidine sesquisulfate monohydrate.

30. A process of color developing a photographic element which comprises contacting said element with a color developing composition containing a primary aromatic amino color developing agent stabilized against aerial oxidation with a combination of (1) an hydroxylamine and (2) a member selected from the group consisting of (a) alkanolamines which are free of carboxyl substitution, and are represented by the formula

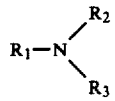

wherein $R_1$ is an hydroxyalkyl group of 2 to 6 carbon atoms and each of $R_2$ and $R_3$ is a hydrogen atom, an alkyl group of 1 to 6 carbon atoms, an hydroxyalkyl group of 2 to 6 carbon atoms, a benzyl radical, or a

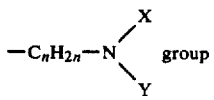

wherein n is an integer of from 1 to 6 and each of X and Y is a hydrogen atom, an alkyl group of 1 to 6 carbon atoms, or an hydroxyalkyl group of 2 to 6 carbon atoms, (b) aliphatic monoamino monocarboxylic acids of up to 3 carbon atoms, and (c) aminobenzoic acids.

31. A process as claimed in claim 30 wherein said hydroxylamine is a compound of the formula

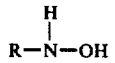

wherein R is a hydrogen atom or an alkyl group of 1 to 3 carbon atoms, or a water-soluble acid salt thereof.

32. A process as claimed in claim 30 wherein said alkanolamine has the formula:

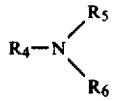

wherein $R_4$ is an hydroxyalkyl group of 2 to 4 carbon atoms and each of $R_5$ and $R_6$ is an alkyl group of 1 to 4 carbon atoms, or an hydroxyalkyl group of 2 to 4 carbon atoms.

33. A process as claimed in claim 30 wherein said hydroxylamine is hydroxylamine sulfate.

34. A process as claimed in claim 30 wherein said alkanolamine is triethanolamine.

35. A process as claimed in claim 30 wherein said alkanolamine is diethanolamine.

36. A process as claimed in claim 30 wherein said alkanolamine is 2-dimethylaminoethanol.

37. A process as claimed in claim 30 wherein said aliphatic monoamino monocarboxylic acid is glycine.

38. A process as claimed in claim 30 wherein said aminobenzoic acid is ortho-aminobenzoic acid.

39. A process as claimed in claim 30 wherein said developing agent is 4-amino-N-ethyl-N-(β-methane-sulfonamidoethyl)-m-toluidine sesquisulfate monohydrate.

* * * * *